US005818176A

United States Patent [19]

Röhr et al.

[11] Patent Number: 5,818,176

[45] Date of Patent: Oct. 6, 1998

[54] CIRCUIT ARRANGEMENT FOR THE OPERATION OF DISCHARGE LAMPS

[75] Inventors: Klaus Röhr, Berlin; Karl Eibisch, Zeuthen, both of Germany

[73] Assignee: Bison Engineering, Sondermaschinen- und Gerätebau GmbH, Frankfurt, Germany

[21] Appl. No.: 762,698

[22] Filed: Dec. 12, 1996

Related U.S. Application Data

[63] Continuation of Ser. No. 693,860, Aug. 5, 1996, abandoned, which is a continuation-in-part of Ser. No. 373,405, Jan. 17, 1995, abandoned.

[30] Foreign Application Priority Data

Jan. 17, 1994 [DE] Germany ..... 44 01 490.2
Apr. 8, 1994 [DE] Germany ..... 44 12 458.9

[51] Int. Cl.[6] ..... H05B 37/02

[52] U.S. Cl. ..... 315/307; 315/DIG. 4; 315/DIG. 7; 315/224; 315/219

[58] Field of Search ..... 315/219, DIG. 7, 315/DIG. 4, 224, 307

[56] References Cited

U.S. PATENT DOCUMENTS

| | | | |
|---|---|---|---|
| 3,263,122 | 7/1966 | Genuit | 315/219 |
| 4,775,822 | 10/1988 | Statnic et al. | 315/224 |
| 4,855,860 | 8/1989 | Nilssen | 315/307 |
| 5,087,859 | 2/1992 | Blankers | 315/219 |
| 5,142,202 | 8/1992 | Sun et al. | 315/219 |

*Primary Examiner*—Benny Lee
*Assistant Examiner*—Michael B. Shingleton
*Attorney, Agent, or Firm*—Christie, Parker & Hale, LLP

[57] ABSTRACT

A bridge circuit arrangement for the operation of discharge lamps comprises a direct voltage source-supplied inverter (2) whose terminals {8,9) are connected to the series circuit of an inductor (10) and a discharge lamp (11}. By means of the symmetrical arrangement of the capacitor (14) with regard to the branches of the bridge circuit, the asymmetrical pulse load on the operating voltage is minimized and the grid filter {1) can have a simpler design. This allows economical manufacture of the discharge lamp with electronic ballast.

9 Claims, 2 Drawing Sheets

CIRCUIT ARRANGEMENT FOR THE OPERATION OF DISCHARGE LAMPS

CROSS-REFERENCE TO RELATED APPLICATION

This is a continuation of application Ser. No. 08/693,860, filed Aug. 5, 1996 now abandoned and which is a CIP of application Ser. No. 08/373,405, filed Jan. 17, 1995 now abandoned.

CROSS REFERENCE TO RELATED APPLICATIONS

Reference is made to PCT International Application WO 93/00784, published on Jan. 7, 1993, which is assigned to the assignee of the present application.

FIELD OF THE INVENTION

The invention relates to a circuit arrangement for the operation of discharge lamps, especially low-pressure discharge lamps, having a direct voltage source-supplied inverter, to whose output the series circuit of an inductor and a discharge lamp is connected and which has at least two power switches, whose control electrodes are connected to a trigger circuit.

BACKGROUND OF THE INVENTION

The term "operation of a discharge lamp" is understood to mean all states of the discharge lamp, from firing to burning steadily. In order to guarantee the firing and operation of the discharge lamp, among other provisions an electronic ballast is connected between the supply grid and the discharge lamp. The electronic ballast should be designed so that, on the one hand, dependable operation of the discharge lamp is guaranteed, and on the other hand, the electronic ballast can be economically mass produced.

There are known electronic ballasts for gas discharge lamps having a circuit arrangement in which a bridge converter is supplied by means of a direct voltage source via two direct voltage input terminals and have at least two controllable power switch elements. The series connection of an inductor and a gas discharge lamp is provided at the output of the bridge converter.

In the known electronic ballasts, to limit the switching transients of the inductor voltage, a capacitor is used which is integrated into a branch of the bridge arrangement and is intended to hinder possible damage to the electronic ballast. Typically, the capacitor is of the order of 1.5 nf. Upon switching of the power switches, the asymmetrical arrangement of the capacitors in the bridge circuit leads to asymmetrical feedback to the direct voltage source and therefore to an asymmetrical pulse load on the operating voltage. To suppress the feedback of these fundamental components from the bridge converter to the grid, the grid filter must have a correspondingly complicated and costly design.

A complicated and expensive design of the grid filter makes it more difficult to manufacture the most compact electronic ballast possible. Since the electronic ballast is of crucial importance to the reliable functioning of a discharge lamp, the entire proposition of striving to mass produce the low pressure discharge lamps simply and economically becomes more difficult.

SUMMARY OF THE INVENTION

The object of the present invention is to create an electronic ballast for the operation of discharge lamps that minimizes the asymmetrical pulse load on the supply voltage and allows a simple and space-saving design of the grid filter. It should be possible to guarantee adequate protection of the arrangement from excessive rates of rise of the voltage coming from the inductor in the electronic ballast. Further, means to increase the voltage can also be provided in the lamp circuit, which should ensure that upon operation on so-called medium-voltage grids having ca 120V line voltage in the lamp circuit, an adequately high AC voltage can be achieved to fire the fluorescent lamp.

According to the invention this object is attained in that the inductor and the discharge lamp are components of a two-terminal network in which means are provided for increasing voltage and/or for limiting the rate of rise of the voltage coming from the inductor, i.e., limiting the switching transients generated by the inductor.

The attainment of the object of the invention makes possible integration of the means for increasing voltage and for limiting the switching transients of the induced voltages generated by the inductor to the circuit arrangement in such a way that asymmetrical feedback of the fundamental oscillations of the inverter to the direct voltage source is minimized, and the operating voltage is essentially symmetrically loaded. The reduction of the low-band (asymmetrical) portions in the circuit frequency of the inverter reduces the expenditure necessary to design the grid filter.

The invention is based on the knowledge that the asymmetrical pulse load on the operating voltage can be reduced if the means for limiting the switching transients and for increasing voltage can be integrated into a two-terminal network along with the discharge lamp and the inductor, so that they are disposed symmetrically with regard to both branches of the circuit arrangement, i.e. especially with respect to the power switches.

To limit the switching transients of the voltages coming from the inductor, a capacitor can be used which is disposed in the two-terminal network in parallel with the inductor and the discharge lamp and consequently symmetrically with respect to both branches of the circuit arrangement.

In a suggested embodiment of the invention, the inverter is embodied as a half bridge.

Preferably, the two-terminal network is connected at one end to the output of the inverter and at the other end to the middle terminal of the capacitive voltage divider of the half bridge. The asymmetrical pulse load on the operating voltage is reduced by means of this symmetrical arrangement of the two-terminal network with respect to both branches of the half bridge.

The power switches of the inverter can be controlled via a transformer whose primary winding within the two-terminal network is connected in series with the discharge lamp.

The primary winding of the transformer is preferably applied on one end to the terminal of the two-terminal network remote from the output of the inverter. Particularly in the event that the inverter is embodied as a half bridge, the transformer in this arrangement has only the coupling capacity to the inverter in the event of a break in the coil of the discharge lamp or in the event that the lamp is not inserted. Given a suitable layout of the printed circuit board, this capacity can be chosen as small, so that the self-excitability of the circuit arrangement when the discharge lamp is either missing or not functioning is substantially less than when the transformer on one side contacts the output of the inverter, and then with its second terminal has a very high static capacity compared to the remainder of the circuit. In the latter case, the embodied capacities can excite the inverter to oscillate at such a high frequency that the power switches—for example switching transistors—are destroyed by heat.

In the case where the necessary arc voltage drop of the discharge lamp is higher than or the same as the voltage contacting the two-terminal network, it is advantageous to integrate a second capacitor into the two-terminal network in parallel with the lamp, which capacitor, along with the inductor, forms an acceptor circuit for increasing the voltage. Also, the second capacitor is connected so that it is disposed symmetrically with regard to the branches of the bridge circuit.

This capacitor preferably contacts the terminal of the two-terminal network on one end remote from the output of the inverter, especially in the case of a half bridge arrangement, in order to prevent an oscillatory stimulation of the arrangement in the event that the lamp is missing or not functioning.

To produce a lamp voltage which is higher than or equal to the voltage contacting the two-terminal network, another possibility lies in integrating into the two-terminal network a high-frequency stray field transformer to increase the lamp voltage. The primary winding of the transformer is connected in parallel with the discharge lamp and if need be with the transformer for triggering the power switches and the secondary winding is connected in series with the discharge lamp so that, particularly in the case of a half bridge arrangement, if the heating coil is interrupted or if the discharge lamp is removed, then the inverter connot be stimulated to oscillate.

If the inverter should remain in operation upon removal of the lamp, the high-frequency stray field transformer can be integrated into the two-terminal network so that the arrangement can oscillate even without the lamp. This is possible if the primary winding of the high-frequency stray field transformer is connected in series with the transformer for triggering the power switches. In this arrangement, the ohmic losses during operation without the lamp are so slight and the frequency of the inverter is changed so insignificantly that no transistor damage can occur.

Further advantages of the invention will become more apparent from the ensuing description, in which exemplary embodiments of the invention will be further explained in conjunction with four drawing figures.

DESCRIPTION OF THE PREFERRED EMBODIMENTS

Figure 1:
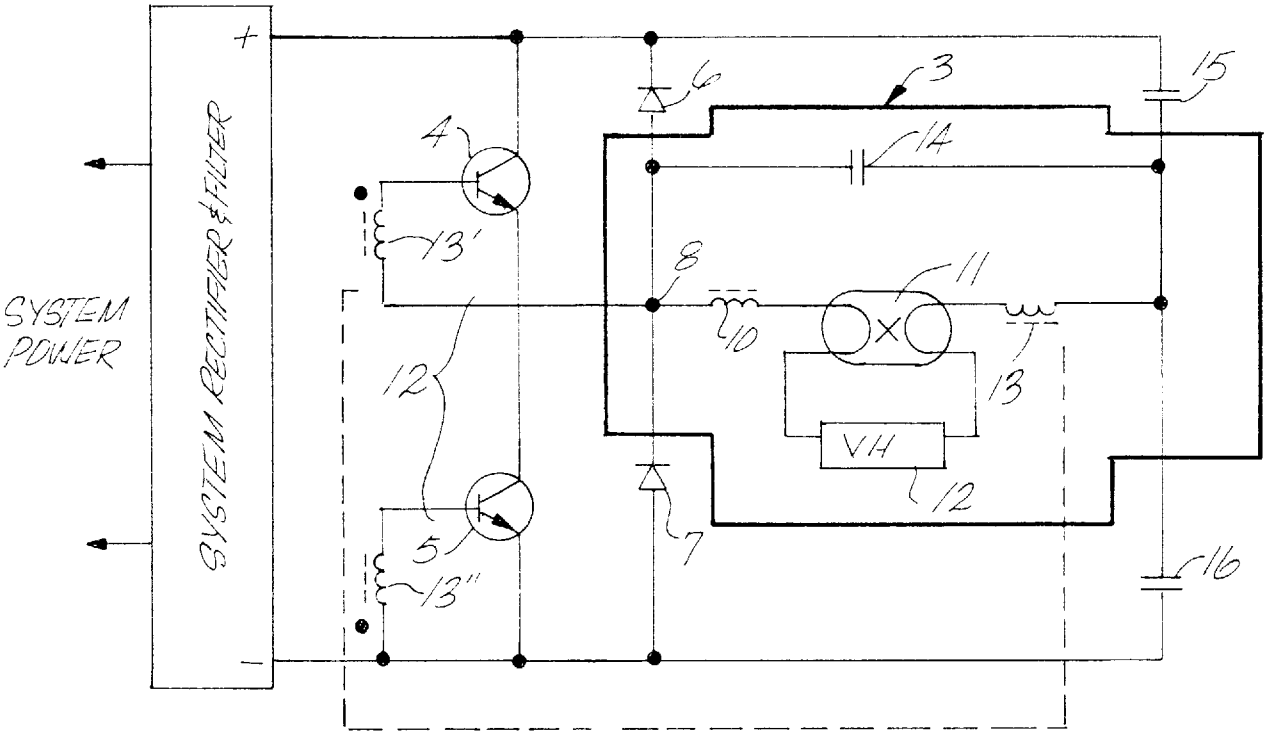
FIG. 1 shows a circuit arrangement for an electronic ballast having a discharge lamp integrated into a two-terminal network in parallel with a switching edge-limiting capacitor.

FIG. 1 shows a circuit arrangement for an electronic ballast for operating discharge lamps. The circuit has a grid (smoothing) filter and a rectifier 1, which can be connected to an alternating voltage power supply grid.

The direct voltage output of the grid filter and rectifier 1 supplies an inverter 2 in half bridge arrangement. Capacitors 15 and 16 comprise the other half of the bridge arrangement. The bridge arrangement has an output 8 on the inverter side of the bridge and an output 9 on the capacitor side of the bridge. The series circuit of a two-terminal network 3 is connected across terminals 8 and 9. The two-terminal network 3 includes the series circuit of an inductor 10, a discharge lamp 11, and the primary winding 13 of a step up transformer 13, 13'. A capacitor 14 is connected in parallel to this circuit.

The electrodes of the gas discharge lamp 11 are additionally connected to a preheating circuit 12. The primary winding 13 of the transformer is connected between one electrode of the gas discharge lamp 11 and the output 9 of the capacitive voltage divider. The inverter 2 has power switches 4, 5 in the respective bridge branches of the half bridge arrangement; these switches comprise transistors, in the exemplary embodiment shown in FIG. 1. The primary winding 13 serves to trigger the power switches 4, 5 of the inverter 2.

Recovery diodes 6, 7 are connected to the load terminals of the power switches 4, 5 in the reverse direction. The control electrodes of the power switches 4, 5 are connected to the secondary windings 13', 13" of the transformer.

The operation of the electronic ballast for discharge lamps, shown in FIG. 1, will now be explained in detail.

The AC voltage applied to the grid filter and rectifier 1 is converted so that a smoothed direct voltage is supplied to the output of the grid filter and rectifier 1. This smoothed direct voltage is converted by means of the inverter 2 into a very high square wave voltage by alternately bringing the controllable power switches 4, 5 of the half bridge arrangement of the inverter 2 into the conductive state; the control of the power switches 4, 5 is achieved with the help of the transformer 13, 13', 13"

The high frequency a.c. voltage across the terminals 8 and 9 is delivered to the two-terminal network 3. The high voltage at the natural frequency of the series circuit leads to the firing of the discharge lamp 11; the series circuit comprises the inductor 10 and the internal capacitance of the preheating circuit 12.

The capacitor 14 serves to limit the switching transients of the induction voltage from the inductor 10. Due to symmetrical position of capacitor 14 in the two-terminal network 3 with respect to both of the branches of the half bridge arrangement, the asymmetrical pulse load on the operating voltage is reduced, as is the expenditure necessary to suppress the feedback of the fundamental of the inverter 2 to the grid. By connecting one end of the primary winding 13 of the transformer that triggers the power switches 4, 5 to the middle terminal 9 of the capacitive voltage divider, in the event of a break in the coil, or removal of the discharge lamp 11, this divider only has left the coupling capacitance of the inverter 2, which strongly reduces the self-excitability of the arrangement and protects the transistors 4, 5 from destruction.

Figure 2:
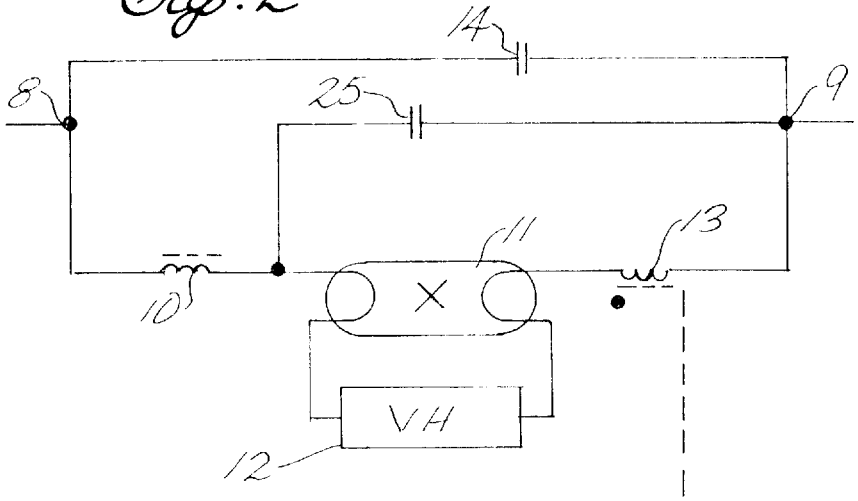
FIG. 2 shows a two-terminal network according to FIG. 1 having a second capacitor.

FIG. 2 shows an alternative embodiment of the two-terminal network 3. This two-terminal network, in comparison with the one shown in FIG. 1, has an additional, second capacitor 25, which forms with the inductor 10 an oscillating series circuit connected in parallel with the discharge lamp 11 and the transformer 13. This oscillating series circuit is connected between terminals 8 and 9. Because of the arrangement of the second capacitor 25 in parallel with the discharge lamp 11 and the transformer 13, it is nearly impossible to stimulate the circuit arrangement to oscillate in the event of an interruption of the heating coil, or removal of the discharge lamp 11. Thus, the circuit is even more effectively protected.

The additional oscillating series circuit serves to increase the voltage at the discharge lamp 11. This works over a broad frequency range because of the strong attenuation in the burning phase of the discharge lamp 11. The embodiment of the two-terminal network 3 described here is useful whenever the necessary arc voltage drop of the discharge lamp 11 is higher than or equal to the voltage across the two-terminal network 3. It is important that the connection of the additional capacitor 25 to the terminal 9 of the capacitive voltage divider reduces the asymmetrical pulse load on the grid.

Figure 3:
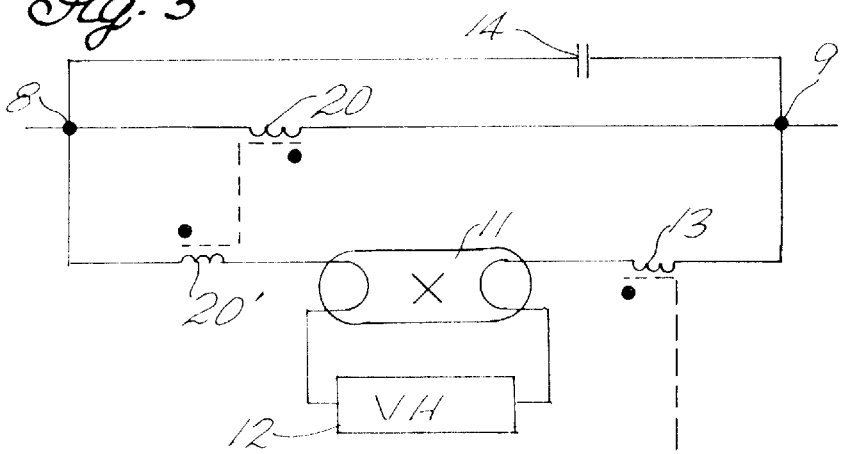
FIG. 3 shows a two-terminal network according to FIG. 1 having a high-frequency stray field transformer whose primary winding is connected in parallel with the switching edge-limiting capacitor.

FIG. 3 shows a further alternative embodiment of the two-terminal network 3 that is likewise suitable for the operation of discharge lamps having higher arc voltage drops than the voltage in the two-terminal network 3. This two-terminal network 3 is composed of the series circuit of the secondary winding 20' of a high-frequency stray field transformer, the discharge lamp 11, and the primary winding 13 of the transformer that triggers the power switches 4, 5. For this purpose, the primary winding 20 of the high-frequency stray field transformer and the capacitor 14 for limiting the switching transients are connected in parallel.

The high-frequency stray field transformer 20, 20' is magnetically coupled so that it increases the voltage across the discharge lamp. A turns ratio of one should be chosen for use in 110V–120V lines. A broad range for the arc voltage drop of the discharge lamp 11 is possible because of the high-frequency stray field characteristic of the transformer 20, 20' As with the above described embodiments of the two-terminal network, no oscillatory stimulation of the inverter 2 is possible upon interruption of the heating coil or removal of the discharge lamp 11.

Figure 4:
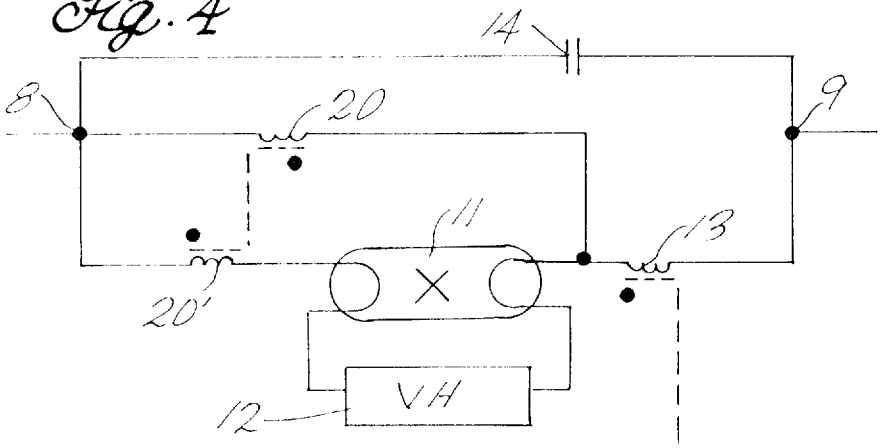
FIG. 4 shows a two-terminal network according to FIG. 1 having a high-frequency stray field transformer whose primary winding is connected in parallel with the switching edge-limiting capacitor and is connected to a terminal of the discharge lamp.

FIG. 4 shows a fourth alternative embodiment of the two-terminal network 3. The two-terminal network comprises the same components as that shown in FIG. 3, although in this case the primary winding 20 of the high-frequency stray field transformer is connected at one end to the output 8 of the inverter 2 and at the other end to the junction of the discharge lamp 11 and the transformer 13 that triggers the power switches 4, 5. This arrangement, as opposed to those described above, can oscillate after corresponding excitation, even without the discharge lamp.

Since the frequency of these oscillations is only a little higher than that of normal operation and the ohmic losses when the discharge lamp 11 has been removed are so slight that destruction of the transistors 4, 5 cannot ensue, this arrangement is suitable for those applications in which the inverter should remain functional on removal of the discharge lamp 11. If a turns ratio of one is chosen for the high-frequency stray field transformer 20, 20', then when the discharge lamp is absent, the result is an approximately doubling of the voltage at the lamp terminals, compared with the voltage in the two-terminal network 3.

The possible embodiments of the invention apparent from the claims are not limited to an inverter in half bridge arrangement. The symmetrical arrangement according to the invention of the means for limiting the switching transients and for increasing the voltage in a two-terminal network can be applied in the same manner to an inverter that has a full bridge design.

Attached as Appendix A is a copy of the priority German application P 44 01 490.2, the disclosure of which is incorporated herein by reference.

We claim:

1. A circuit arrangement for operation of a discharge lamp comprising:

an inverter comprising first and second branches for providing an AC voltage output generated from a DC voltage source; and a two terminal network coupled in a first parallel circuit with the first branch and coupled in a second parallel circuit with the second branch, said two terminal network comprising a discharge lamp and means for increasing said AC voltage output from the inverter said increased AC voltage output being applied to said discharge lamp when said discharge lamp is burning steadily.

2. The circuit arrangement according to claim 1 further comprising a switching edge-limiting capacitor coupled in parallel with the two terminal network.

3. The circuit arrangement according to claim 1 wherein said inverter further comprising a pair of capacitors forming third and fourth branches, each capacitor being disposed in a different one of the parallel circuits of the two terminal network.

4. The circuit arrangement according to claim 1 wherein said inverter comprises a plurality of power switches for generating said AC voltage output, each of said plurality of power switches having a gate input coupled to a secondary winding of a transformer, and wherein said two terminal network further includes a primary winding of said transformer coupled to said discharge lamp for triggering said plurality of power switches.

5. The circuit arrangement according to claim 4 wherein said primary winding is connected in series with said discharge lamp.

6. The circuit arrangement according to claim 1 wherein said means for increasing said AC voltage output comprises a capacitor and an inductor arranged to form a resonant circuit.

7. The circuit arrangement according to claim 6 wherein said inductor is connected in series with a parallel circuit comprising said discharge lamp and said capacitor.

8. The circuit arrangement according to claim 1 wherein said means for increasing said AC voltage output comprises a high frequency stray field transformer having primary and secondary windings, said primary winding connected in parallel to a series circuit comprising said secondary winding and said discharge lamp.

9. The circuit arrangement according to claim 8 wherein said stray field transformer has a turns ratio of one.

* * * * *